US005634364A

United States Patent [19]

Gardner et al.

[11] Patent Number: 5,634,364

[45] Date of Patent: Jun. 3, 1997

[54] SEGMENTED COIL FOR USE IN ELECTROMAGNETIC CAN FORMING

[75] Inventors: Terrance L. Gardner, Mechanicsville; Horst F. Arfert, Midlothian, both of Va.

[73] Assignee: Reynolds Metals Company, Richmond, Va.

[21] Appl. No.: 566,619

[22] Filed: Dec. 4, 1995

[51] Int. Cl.[6] ..... B21D 26/14

[52] U.S. Cl. ..... 72/56; 72/430; 72/707

[58] Field of Search ..... 72/54, 56, 430, 72/707

[56] References Cited

U.S. PATENT DOCUMENTS

| | | | |
|---|---|---|---|
| 2,976,907 | 3/1961 | Harvey et al. . | |
| 3,236,080 | 2/1966 | Illgen . | |
| 3,345,732 | 10/1967 | Brower | 72/56 |
| 3,376,633 | 4/1968 | Wesley . | |
| 3,412,188 | 11/1968 | Seefluth . | |
| 3,599,461 | 8/1971 | Astl | 72/56 |
| 3,599,462 | 8/1971 | Kline | 72/56 |
| 3,691,267 | 9/1972 | Takehara . | |
| 3,810,372 | 5/1974 | Queyroix . | |
| 3,810,373 | 5/1974 | Queyroix . | |
| 3,896,647 | 7/1975 | Mikhailov et al. | 72/56 |
| 3,975,936 | 8/1976 | Baldwin et al. . | |
| 4,034,036 | 7/1977 | Farrell . | |
| 4,120,924 | 10/1978 | Rainville . | |
| 4,617,077 | 10/1986 | Giese et al. . | |
| 4,898,708 | 2/1990 | Holoubek et al. . | |
| 4,947,667 | 8/1990 | Gunkel et al. . | |
| 5,058,408 | 10/1991 | Leftault, Jr. et al. . | |
| 5,353,617 | 10/1994 | Cherian et al. . | |

FOREIGN PATENT DOCUMENTS

| | | |
|---|---|---|
| 60-106628 | 6/1985 | Japan . |

*Primary Examiner*—David Jones
*Attorney, Agent, or Firm*—Robert C. Lyne, Jr.

[57] ABSTRACT

An expandable, segmented coil is disclosed for use in electromagnetic can forming. The segmented coil comprises a central camshaft and a plurality of coil segments equally spaced about the central camshaft. Each of the plurality of coil segments comprises a coil core and a conductive tubing. The coil core including a central longitudinal bore and a profiled plate cooperating with the camshaft and movable between a collapsed position and an expanded position upon rotation of the camshaft. The tubing being routed through the central bore, wrapped around the coil core to form coil windings, and terminating in a conductor terminal for connection to a power supply for energization of the coil. The central camshaft includes an elongated shaft with a profiled cam plate on one end thereof. Each profiled plate of the coil core includes a cam follower cooperating with the profiled cam plate to cause movement of the coil segments between the collapsed position and the expanded position.

20 Claims, 3 Drawing Sheets

SEGMENTED COIL FOR USE IN ELECTROMAGNETIC CAN FORMING

TECHNICAL FIELD

The present invention relates generally to manufacturing cans for beverages such as soft drinks, beer, and juices, and, more particularly, to an expandable, segmented coil for use in electromagnetic (EM) forming a can to contour its sidewall.

BACKGROUND ART

Beverages such as soft drinks, beer, tea, juice, water, and concentrate are commonly sold in metal cans. A typical can includes a bottom wall having an inwardly disposed concave dome shape, and a cylindrical sidewall extending from the bottom wall and terminating in a necked end to which a can end is secured. The end includes a score line and a stay-on-tab attached by a rivet outside the score line.

The sidewalls of these metal can bodies are typically formed by a drawing and ironing (D&I) process. In the beer and beverage industry, the cans have a nominal can diameter of, for example, two and eleven sixteenths inches (a "211 can") and, after being filled with beverage, the open end is sealed with the can end. Prior to filling, the open end is necked in, for example, to a neck diameter of 206 (two and six sixteenths inches) on the standard 211 can or possibly to a 204 neck (two and four sixteenths) or a 202 neck. Typical processes for necking cans are disclosed in U.S. Pat. No. 5,297,414 to Sainz (die necking) and U.S. Pat. No. 5,245,848 to Myrick et al (spin flow necking).

Typically, the exterior surface of the can sidewall is printed with advertising and other information. The interior surface has a clear coating that prevents the can contents from chemically interacting with the metal sidewalls.

Selected areas of the exterior wall may also be mechanically deformed in various ways to enhance their appearance. It is known to form or shape cans by embossing the sidewalls of such cans in various aesthetically appealing patterns which may comprise marks or outlines associated with a particular beverage and company, as disclosed for example in U.S. Pat. No. 3,628,451 to McClellan et al., entitled "Apparatus For and Method Of Shaping Workpieces".

An alternative method for expanding the sidewall of a can using EM forces is disclosed in U.S. Pat. No. 4,947,667 to Gunkel et al., entitled "Method and Apparatus For Forming a Container." In EM forming, a magnetic field of relatively high intensity is formed by passing an electric current through a constant diameter coil consisting of a conductive wire which is typically supported by a nonconductive structure. The coil is inserted into the constant diameter can interior through the open end in close, yet radially spaced proximity to the can sidewall. The current produces a pulsed magnetic field which induces a current in the adjacent conductive can. The induced current in the workpiece reacts with the magnetic field to produce a force which is directed against the adjacent can sidewall, deforming it radially outward, preferably into a mold including a contoured inner cavity.

Contouring the sidewall reduces the column strength of the can, which may make some necking processes, for example die necking, unsuitable if necking is performed after EM contouring. On the other hand, reversing the order of the steps and performing necking before EM contouring by prior art processes is also undesirable, since it may be impossible for the diameter of the EM coil to be small enough to allow the coil to fit through the neck, yet large enough to position the coil sufficiently close to the can sidewall for the EM forces to do their job efficiently and effectively.

DISCLOSURE OF THE INVENTION

An object of the invention is to provide an improved coil permitting EM forming of a reduced neck diameter can.

A further object of the invention is to provide an improved method of forming a can with a contoured sidewall and a necked-in end appropriate for securing an end thereon.

These and other objects are achieved by the segmented coil for EM forming of the present invention.

According to the present invention, a segmented coil is disclosed for use in EM can forming. The segmented coil comprises a central camshaft and a plurality of coil segments equally spaced about the central camshaft. Each of the plurality of coil segments comprises a coil core and a conductive tubing. The coil core includes a central longitudinal bore and a profiled plate cooperating with the camshaft and movable between a collapsed position and an expanded position upon rotation of the camshaft. The tubing is routed through the central bore, wrapped around the coil core to form coil windings, and terminates in a conductor terminal for connection to a power supply for energization of the coil.

According to a preferred embodiment, the central camshaft includes an elongated shaft with a profiled cam plate on one end thereof. The second end of the shaft is adapted to be rotatably driven. Preferably, the cam plate is generally circular in cross section with a plurality of cutouts evenly disposed about the circumference of the cam plate, the plurality of cutouts corresponding in number to the plurality of coil segments.

Also preferably, each profiled plate of the coil core includes an inwardly projecting cam follower cooperating with one of the plurality of cutouts. Each cam follower is received in one of the plurality of cutouts when the coil is in the collapsed position. Upon rotation of the camshaft, each cam follower is caused to ride the surface of one of the plurality of cutouts toward the circumference of the cam plate to the expanded position.

According to another aspect of the invention, each of the plurality of coil segments is secured at a lower end to one of a plurality of coil slide plates.

According to yet another aspect of the invention, a fixed guide plate is provided including a plurality of keys. Each coil slide plate is received within and guided by one of the plurality of keys.

Preferably, an O-ring disposed about the plurality of coil slide plates to bias the plurality of coil slide plates toward the collapsed position upon rotation of the camshaft.

According to another preferred embodiment, the central camshaft includes a cam guide on a lower end thereof. The cam guide is generally circular in cross section with a plurality of cutouts evenly disposed about the circumference of the cam guide. Each of the plurality of coil slide plates includes a projecting cam follower cooperating with one of the plurality of cutouts. Each cam follower is received in one of the plurality of cutouts when the coil is in the collapse position, and upon rotation of the central camshaft, each cam follower is caused to ride the surface of one of the plurality of cutouts toward the circumference of the cam plate to the expanded position.

The conductive tubing is preferably made of radium copper tubing, and preferably is approximately 0.125 inches in diameter.

Insulation may be disposed between the central camshaft and the plurality of coil segments.

According to another aspect of the invention, a method of contouring the sidewall of a can is disclosed. The method comprising the steps of forming the can by drawing and ironing, and forming a reduced diameter neck end. The can is placed in a mold with an internal cavity surface contoured to the desired finished contour of the can. A segmented coil is provided, movable between a collapsed position and an expanded position. The can and the segmented coil in the collapsed position are positioned so that the segmented coil is inside the can, whereupon the coil is expanded to the expanded position. The coil is energized to provide an EM force sufficient to cause the sidewall of the can to form against the internal cavity surface of the mold. The coil is retracted to the collapsed position, the coil is removed from the can, and the can is released from the mold.

Preferably, the diameter of the segmented coil in the collapsed position is less than the diameter of the reduced diameter neck end, and the diameter of the segmented coil in the expanded position exceeds the diameter of the reduced diameter neck end.

BEST MODE FOR CARRYING OUT THE INVENTION

Figure 1:
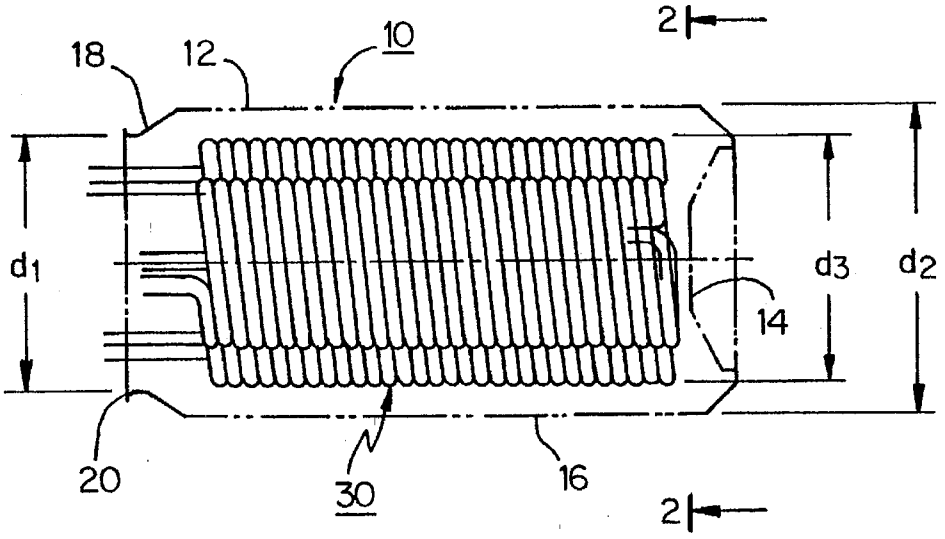
FIG. 1 is a side view of the a with the coil disposed inside the can in the collapsed position, with the can shown in phantom and the structural support of the coil omitted for clarity.

Referring to FIG. 1 of the drawing, necked can 10 is depicted in phantom. Body 12 of can 10 includes a conventional bottom wall 14 of an inwardly disposed concave dome shape. Cylindrical sidewall 16 extending from the bottom wall 14 and terminates in necked-in opening 18. Can 10 is preferably formed utilizing a drawing and ironing (D&I) process as is well known. The D&I process results in a can having a sidewall of a substantially constant diameter. Necked-in opening 18 has an inner diameter $d_1$, as best seen in FIG. 1, which is significantly smaller than the diameter of the straight sidewall $d_2$. Necked-in opening 18 preferably ends in flange 20 to assist in sealing the can with a can end.

Figure 2:
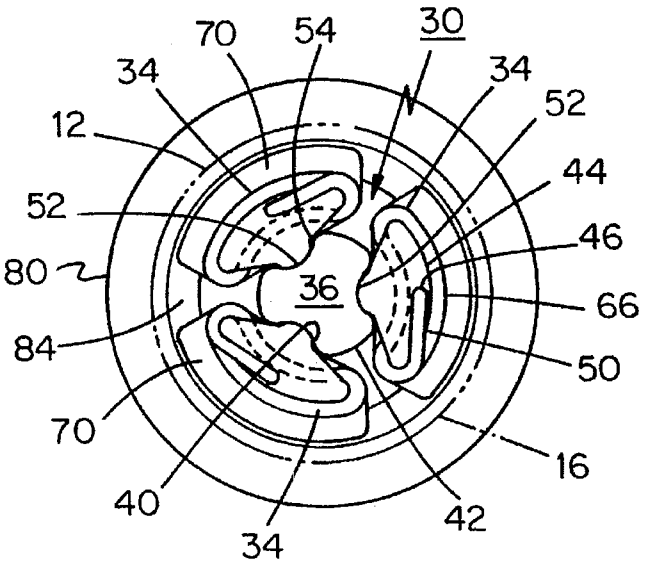
FIG. 2 is a sectional view, taken along lines 2—2 of FIG. 1, of the can with the coil disposed inside the can in the collapsed position, depicting the relationship between the outer diameter of the collapsed coil and the inner diameter of the necked can.
Figure 4:
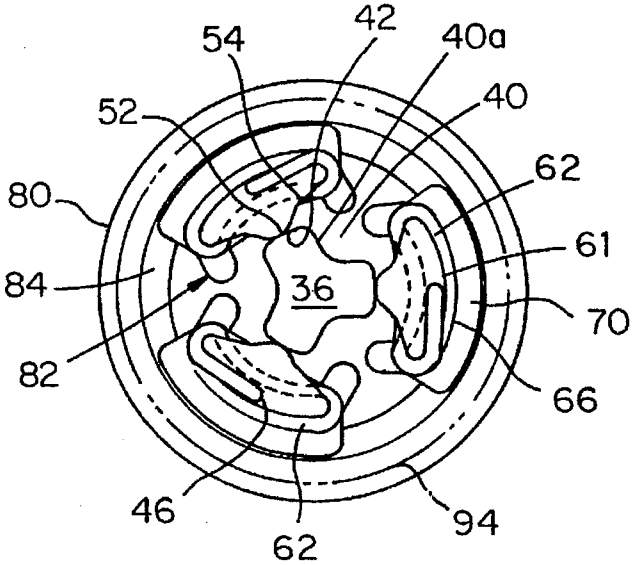
FIG. 4 is a sectional view taken along lines 4—4 of FIG. 2, depicting the coil in the expanded position.
Figure 5:
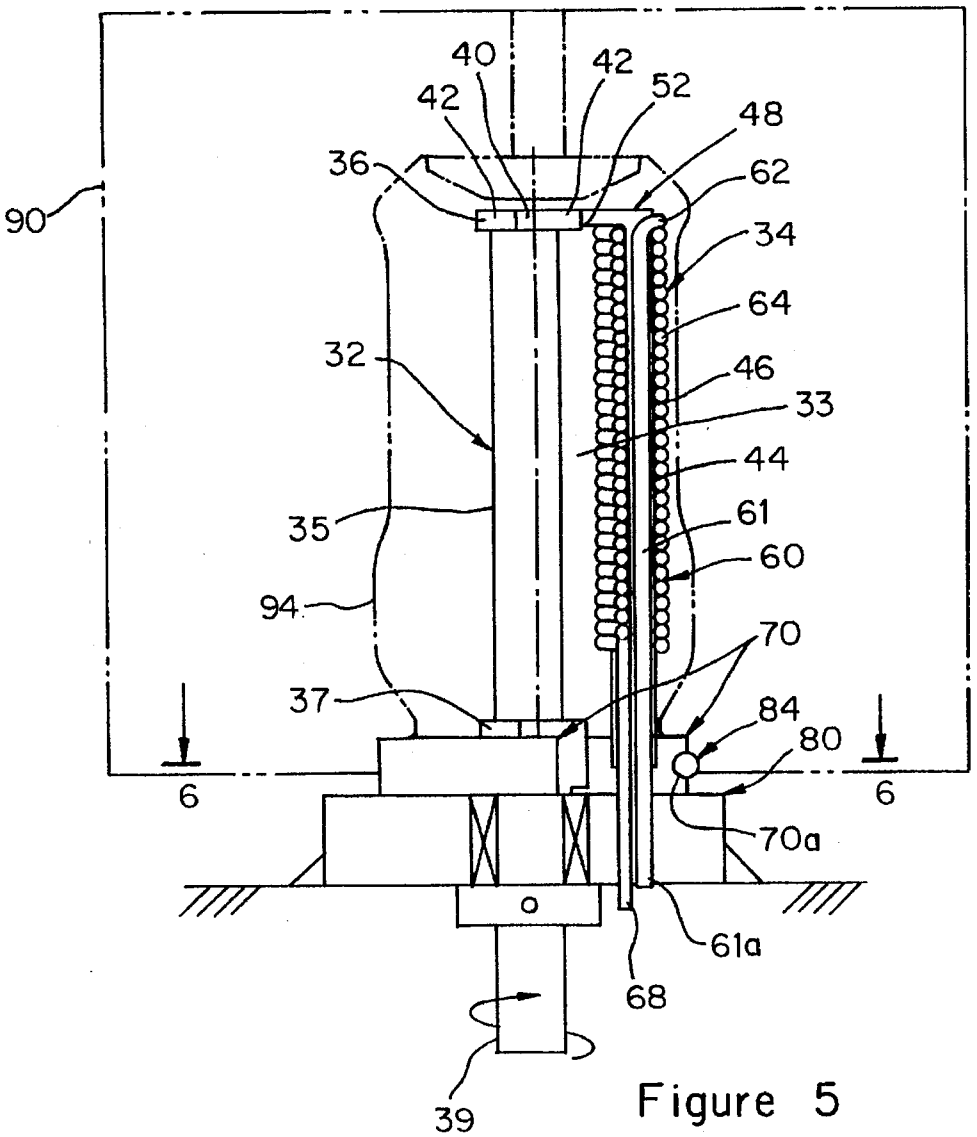
FIG. 5 is an end view of the EM forming apparatus with the coil of FIGS. 1–4 placed in the can and the EM forming mold depicted in phantom.

According to the present invention, coil 30, as depicted in the Figures, generally includes a central camshaft 32 and a plurality of coil segments 34 disposed equally about the circumference of the can. Preferably, insulation 33 is provided between central camshaft 32 and the plurality of coil segments 34, as depicted in FIG. 5. Also preferably, three coil segments 34 are provided, as depicted in FIGS. 2 and 4. Central camshaft 32 includes an elongated, generally cylindrical shaft 35 with a cam plate 36 on one end thereof. The other end of the shaft is received in a cam guide 37 and terminates in an end 39 which is rotatably secured to a drive means (not shown) to turn the shaft. As best seen in FIGS. 2 and 4, cam plate 36 is generally circular in cross-section with three shallow cutouts 40 disposed between protrusions 42. The number of cutouts 40 corresponds in number to the number of coil segments 34, in this instance, three. Cam guide 37, best seen in FIG. 6, is substantially identical in cross-section as cam plate 36, and thus similarly is generally circular in cross-section including three shallow cutouts 37*a* disposed between protrusions 37*b*.

Each coil segment 34 includes a plastic coil core 44 including central longitudinal bore 46 and terminating in profiled plate 48. Core 44 is of an arcuate cross-section, as best seen in FIGS. 2 and 4, the outer surface 50 of the core 44 conforming to the cylindrical shape of the can. A cam follower 52 projects from inner surface 54 of profiled plate 48 and, in the collapsed position of FIGS. 1 and 2, the cam followers 52 are received within the cutouts 40 of cam plate 38. As central camshaft 32 rotates, each cam follower 52 rides the surface 40*a* of cutout 40 toward protrusions 42 to the expanded position of FIGS. 3 and 4.

The coil segments 34 are formed by wrapping a metallic tubing 60, preferably made of ⅛" diameter radium copper tubing, around the plastic coil core 44. Specifically, a central straight length 61 of the copper tubing 60 is first routed through the central bore 46 of the core 44. At the upper surface of the core 44, the length 61 is wrapped around the coil core to form a first winding 62. Copper tubing 60 is continuously wrapped around arcuate coil core 44 to form coil windings 64 extending the length of coil core 44. As copper tubing 60 is wrapped around arcuate coil core 44, the coil windings 64 are likewise arcuate conforming in shape to the arcuate cross section of core 44, with the outer surface 66 of the coil windings 64 conforming to the cylindrical shape of the can. The copper tubing 60 terminates in a conductor terminal 68 for connection, together with an end 61*a* of length 61, to a power supply (not shown) for energization of the coil.

Figure 6:
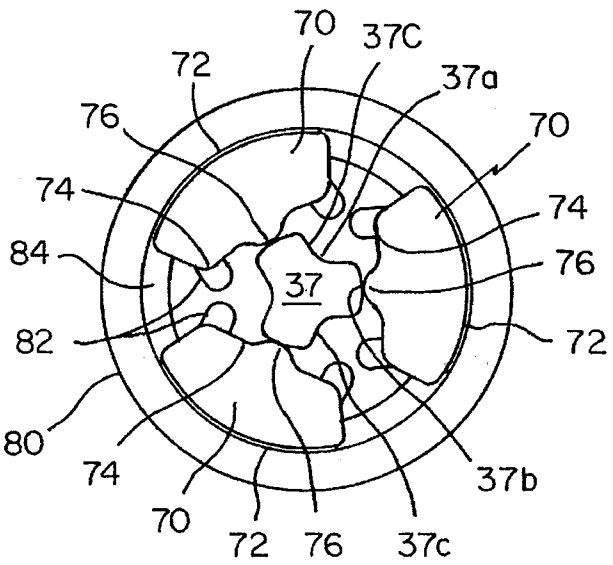
FIG. 6 is a cross-sectional view of the base assembly, taken along lines 6—6 of FIG. 5.

At the base of the assembly, each coil segment 34 is received in a coil slide plate 70, best seen in FIGS. 5 and 6. Referring to FIG. 6, coil slide plate 70 is generally similar in shape as profiled plate 48 and includes an arcuate outer surface 72, preferably generally conforming to the cylindrical shape of the can. The inner surface 74 of coil slide plate 70 includes a cam follower 76 projecting therefrom. In the collapsed position, not shown, the cam followers 74 are received within the cutouts 37*a* of cam guide 37. As central camshaft 32 rotates, each cam follower 52 rides the surface 37*c* of cutout 37*a* toward protrusions 37*b* to the expanded position of FIG. 6.

As depicted in FIG. 5, a fixed guide plate 80 supports the entire assembly. Keys 82, provided in fixed guide plate 80, are adapted to receive coil slide plate 70 to provide structural support for the coil slide plate. Keys 82 also guide the movement of coil slide plate 70 as the cam followers 74 are moved between the collapsed and expanded positions.

To bias the coil slide plates 70 toward the collapsed position, an O-ring 84 is received in a groove 70*a* on the outer surface 72 of the three coil slide plates. Movement of the coil slide plates 70, with cam follower 76 travelling along surface 37*c* of cutout 37*a* toward protrusions 37*b*, to the expanded position is accomplished against the bias of O-ring 84. O-ring 84 further provides sealing of coil 30 to an EM mold 90, depicted in phantom.

The operation of the segmented coil will now be described. referring to FIGS. 1 and 2, the coil 30 in the collapsed position, with cam followers 52 of profiled plate 48 being received within cutouts 40 of cam plate 38 and cam follower 76 of coil slide plate 70 being received within cutouts 37*a* of cam guide 37, has an outer diameter $d_3$ which is less than the inner diameter $d_1$ of the necked-in end 18 (i.e., $d_3<d_1$). It will be appreciated by one of ordinary skill in the art that the maximum outer diameter $d_3$ of the coil in the collapsed position is dictated by the inner diameter $d_1$ of the necked-in end 18. With coil 30 in the collapsed position, coil 30 and can 10 are positioned so that the coil 30 is inside can 10. The EM mold 90, depicted in FIGS. 3 and 5, is placed around the can and secured.

Figure 3:
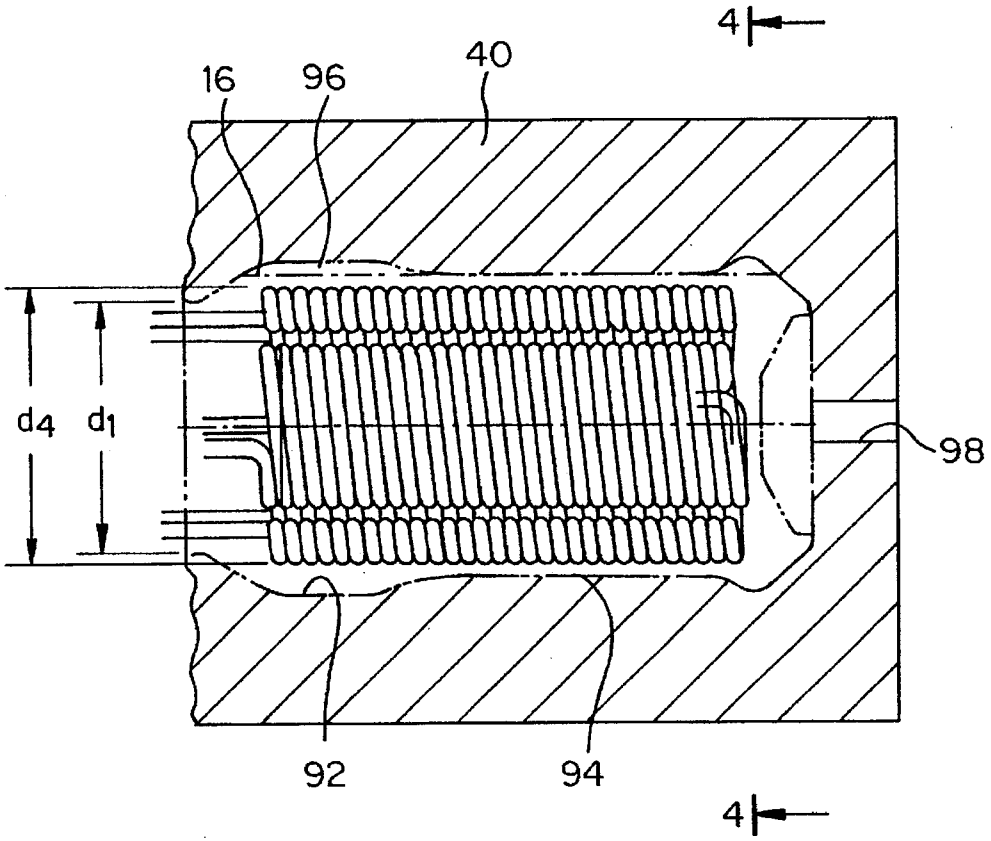
FIG. 3 is a side view of the can positioned in a mold after EM forming with the coil in the expanded position, with the can shown in phantom and the structural support of the coil omitted for clarity.

Referring to FIGS. 3 and 4, the central camshaft 32 is rotated, causing the cam follower 52 of profiled plate 48 to ride the surface 40*a* of cutout 40 of cam plate 38 until cam follower 52 is disposed at the protrusion 42. Similarly, cam follower 76 of coil slide plate 70 is caused to ride the surface 37*c* of cutout 37*a* of cam guide 37, against the bias of O-ring 84, until cam follower 76 is disposed at the protrusion 37*b*. In this expanded position, the coil 30 has an outer diameter $d_4$ which is greater than the inner diameter $d_1$ of the necked-in end 18 (i.e., $d_4>d_1$). Preferably, in the expanded position, the outer surface 66 are disposed within approximately 0.050 inch or closer to the inner surface of the can sidewall 16. In other words, the distance between the inner diameter $d_2$ of the can and the outer diameter $d_4$ of the expanded coil 30 is approximately 0.050 inches (i.e., $d_2-d_4\approx0.050$ inch). (In the drawing, some relationships have been exaggerated to show the differences between the collapsed and the expanded positions, for example, the radial distances traveled by the segments and the distances between the segments.)

With the coil in this expanded position, the conductor terminal 68 and the end 61*a* of length 61 of the metallic tubing 60 are connected to a power supply to energize the coil. Preferably, the power supply is a capacitor to permit almost instantaneous energization of the coil to approximately 10,000 amps in microseconds. The desired forming of sidewall 16 is achieved by the application thereto of an intense EM field produced by the discharge of electrical energy into the coil 30. The force thus generated drives the sidewall 16 against mold 90, thus pushing the sidewall against the contour of the inner surface 92 of the mold cavity to form contoured sidewall 94. This action is almost instantaneous, and for this reason, it is necessary to evacuate the air from the space 96 between the sidewall 16 and the inner surface 92. Otherwise, the entrapped air cannot escape and is compressed with extremely high pressure and temperature by the advancing metallic article being accelerated by the magnetic field, thereby causing defects in the formed shaped, such as bubbles and deformed surfaces. For this reason, a vacuum hole 98 is provided in mold 90, into which a conduit is inserted, the conduit leading to a vacuum pump or the like to permit evacuation of the air trapped in space 94. Once the EM force has been supplied by coil 30, central camshaft 32 is rotated, causing cam followers 54, 76 to be released from projections 42, 37*b*, respectively. Upon release, O-ring 84 then biases cam guide plates 70 to the collapsed position. The coil 30 is then removed from the can, and the can 10 with contoured sidewall 94 is released from the mold.

It will be appreciated by one of ordinary skill in the art that the coil segments 34 may be reconfigured in a number of ways, subject to the following requirements. It is important that the segments not contact one another, in the expanded position. The intense EM force produced by two segments in very close proximity to one another may possibly result in a hole being burned in the can. Secondly, the coil 30 must not touch the can bottom 14 or the pre-necked open end 18 to avoid contamination of the inside coating as well as short circuiting.

One of ordinary skill in the art will also appreciate that the means described herein of expanding the coil is a preferred embodiment, and numerous alternatives to the cammed shaft described herein are available. These alternatives are to be understood as within the scope of the invention described herein.

The segmented coil of the present invention provides a number of advantages over the prior art, single diameter coil. For instance, because the coil in the expanded position may be placed closer to the body of the can, the desired EM forming may be achieved with much less power going through the coil. The segmented coil advantageously permits necking of the can prior to EM forming the contoured surfaces. This permits the open end of the contoured can to be reduced to commercially desirable smaller diameters otherwise achieved in non-contoured cans.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A segmented coil for use in electromagnetic can forming, comprising:

a central camshaft;

a plurality of coil segments equally spaced about the central camshaft, each of the plurality of coil segments comprising a coil core and a conductive tubing;

the coil core including a central longitudinal bore and a profiled plate cooperating with the camshaft and movable between a collapsed position and an expanded position upon rotation of the camshaft, the tubing being routed through the central bore, wrapped around the coil core to form coil windings, and terminating in a conductor terminal for connection to a power supply for energization of the coil.

2. The coil of claim 1, wherein the central camshaft includes an elongated shaft with a profiled cam plate on one end thereof, the second end of the shaft adapted to be rotatably driven.

3. The coil of claim 2, wherein the cam plate is generally circular in cross section with a plurality of cutouts evenly disposed about the circumference of the cam plate.

4. The coil of claim 3, wherein the plurality of cutouts correspond in number to the plurality of coil segments.

5. The coil of claim 3, wherein each profiled plate of the coil core includes an inwardly projecting cam follower cooperating with one of the plurality of cutouts.

6. The coil of claim 5, wherein each cam follower is received in one of the plurality of cutouts when the coil is in the collapsed position.

7. The coil of claim 6, wherein upon rotation of the camshaft, each cam follower is caused to ride the surface of one of the plurality of cutouts toward the circumference of the cam plate to the expanded position.

8. The coil of claim 1, wherein each of the plurality of coil segments is secured at a lower end to one of a plurality of coil slide plates.

9. The coil of claim 8, further comprising a fixed guide plate including a plurality of keys, wherein each coil slide plate is received within and guided by one of the plurality of keys.

10. The coil of claim 8, further comprising an O-ring disposed about the plurality of coil slide plates to bias the plurality of coil slide plates toward the collapsed position upon rotation of the camshaft.

11. The coil of claim 8, wherein the central camshaft includes a cam guide on a lower end thereof, the cam guide being generally circular in cross section with a plurality of cutouts evenly disposed about the circumference of the cam guide, each of the plurality of coil slide plates including a projecting cam follower cooperating with one of the plurality of cutouts, wherein each cam follower is received in one of the plurality of cutouts when the coil is in the collapse position, and upon rotation of the central camshaft, each cam follower is caused to ride the surface of one of the plurality of cutouts toward the circumference of the cam plate to the expanded position.

12. The coil of claim 2, wherein the central camshaft includes a cam guide on the second end thereof, and wherein each of the plurality of coil segments is secured at a lower end to one of a plurality of coil slide plates, the cam guide being generally circular in cross section with a plurality of cutouts evenly disposed about the circumference of the cam guide, each of the plurality of coil slide plates including a projecting cam follower cooperating with one of the plurality of cutouts, wherein each cam follower is received in one of the plurality of cutouts when the coil is in the collapse position, and upon rotation of the central camshaft, each cam follower is caused to ride the surface of one of the plurality of cutouts toward the circumference of the cam plate to the expanded position.

13. The coil of claim 12, further comprising a fixed guide plate including a plurality of keys, wherein each coil slide plate is received within and guided by one of the plurality of keys.

14. The coil of claim 12, further comprising an O-ring disposed about the plurality of coil slide plates to bias the plurality of coil slide plates toward the collapsed position upon rotation of the camshaft.

15. The coil of claim 1, wherein the conductive tubing is preferably made of radium copper.

16. The coil of claim 1, wherein the conductive tubing is approximately 0.125 inches in diameter.

17. The coil of claim 1, further comprising insulation disposed between the central camshaft and the plurality of coil segments.

18. A method of contouring the sidewall of a can, comprising the steps of:

forming the can by drawing and ironing;

forming a reduced diameter neck end;

placing the can in a mold with an internal cavity surface contoured to the desired finished contour of the can;

providing a segmented coil movable between a collapsed position and an expanded position;

positioning the can and the segmented coil in the collapsed position so that the segmented coil is inside the can;

expanding the coil to the expanded position;

energizing the coil to provide an electromagnetic force sufficient to cause the sidewall of the can to form against the internal cavity surface of the mold;

retracting the coil to the collapsed position;

removing the coil from the can; and releasing the can from the mold.

19. The method of claim 18, wherein the diameter of the segmented coil in the collapsed position is less than the diameter of the reduced diameter neck end.

20. The method of claim 18, wherein the diameter of the segmented coil in the expanded position exceeds the diameter of the reduced diameter neck end.

* * * * *